US007207652B2

(12) United States Patent
Gibson et al.

(10) Patent No.: US 7,207,652 B2
(45) Date of Patent: Apr. 24, 2007

(54) BALANCED SATELLITE DISTRIBUTIONS

(75) Inventors: Bruce D. Gibson, Lexington, KY (US); Bruce H. Ostermeier, Georgetown, KY (US); Kent L. Ubellacker, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 237 days.

(21) Appl. No.: 10/688,871

(22) Filed: Oct. 17, 2003

(65) Prior Publication Data

US 2005/0083373 A1 Apr. 21, 2005

(51) Int. Cl.
*B41J 2/14* (2006.01)
*B41J 2/02* (2006.01)

(52) U.S. Cl. ..... 347/47; 347/73

(58) Field of Classification Search ..... 347/47, 347/54, 73, 74, 75, 77, 9
See application file for complete search history.

(56) References Cited

U.S. PATENT DOCUMENTS 3,928,855 A 12/1975 Helinski et al.
3,979,756 A 9/1976 Helinski et al.
3,981,019 A 9/1976 Fujimoto et al.
4,048,639 A 9/1977 Walsh et al.
4,220,958 A 9/1980 Crowley
4,238,804 A 12/1980 Warren
4,246,589 A 1/1981 Denny et al.
4,282,533 A 8/1981 Brooks et al.
4,380,017 A 4/1983 Ort
4,384,296 A 5/1983 Torpey
4,393,385 A 7/1983 Jinnai et al.
4,555,712 A 11/1985 Arway et al.
4,613,875 A 9/1986 Le et al.
4,638,337 A 1/1987 Torpey et al.
4,827,280 A 5/1989 Stamer et al.
5,142,296 A 8/1992 Lopez et al.
5,337,071 A 8/1994 East et al.
5,396,273 A 3/1995 Stamer
5,406,318 A 4/1995 Moore et al.
5,422,664 A 6/1995 Stephany
5,461,406 A 10/1995 Lorenze, Jr. et al.
5,594,479 A * 1/1997 Inoue et al. ..... 347/45
5,638,101 A 6/1997 Keefe et al.
5,859,653 A 1/1999 Aoki et al.
5,867,189 A 2/1999 Whitlow et al.
5,870,117 A 2/1999 Moore
5,896,154 A 4/1999 Mitani et al.
6,053,598 A 4/2000 Inpyn
6,079,809 A * 6/2000 Yaegashi et al. ..... 347/35
6,126,282 A * 10/2000 Oikawa ..... 347/101
6,155,670 A * 12/2000 Weber et al. ..... 347/43

(Continued)

FOREIGN PATENT DOCUMENTS

JP 58217372 A 12/1983

*Primary Examiner*—Shih-Wen Hsieh
(74) *Attorney, Agent, or Firm*—Dinsmore & Shohl

(57) ABSTRACT

A printhead for an inkjet printer includes an ink reservoir and a plurality of nozzles for ejecting ink from the ink reservoir onto print media, the nozzles being formed in the ink jet printer printhead in a predetermined fashion with bores purposefully shaped and directed to determine the formation and placement of main drops and/or satellite droplets when ink is ejected from the ink reservoir when the printhead is part of an inkjet printer.

22 Claims, 22 Drawing Sheets

U.S. PATENT DOCUMENTS 6,220,693 B1 4/2001 Bode et al.
6,247,794 B1 6/2001 Silverbrook
6,250,739 B1 6/2001 Serra
6,264,850 B1 7/2001 Silverbrook
6,276,774 B1 8/2001 Moghadam
6,276,783 B1 8/2001 Ishinaga et al.
6,293,644 B1 9/2001 Markham et al.
6,299,270 B1 * 10/2001 Merrill ..... 347/9
6,299,281 B1 10/2001 Shiida et al.
6,302,505 B1 10/2001 Askeland et al.
6,302,506 B1 10/2001 Norton
6,336,710 B1 1/2002 Silverbrook
6,338,545 B1 1/2002 Sekiya
6,364,447 B1 4/2002 Boleda et al.
6,367,908 B1 4/2002 Serra et al.
6,371,596 B1 4/2002 Maze et al.
6,428,135 B1 8/2002 Lubinsky et al.
6,431,675 B1 8/2002 Chang
6,435,643 B1 8/2002 Miura et al.
6,464,330 B1 10/2002 Miller et al.
6,474,763 B1 11/2002 Murakami et al.
6,491,377 B1 12/2002 Cleland et al.
6,491,833 B1 12/2002 Silverbrook
6,497,467 B2 12/2002 Suwa et al.
6,505,905 B1 1/2003 Krouss
6,505,912 B2 1/2003 Silverbrook et al.
6,523,926 B1 2/2003 Mitsuzawa et al.
6,527,354 B2 3/2003 Takahashi
6,527,376 B1 3/2003 Itaya et al.
6,530,635 B2 3/2003 Otsuki
6,536,869 B1 3/2003 Bland et al.
2002/0054187 A1 5/2002 Kato et al.
2003/0025749 A1 2/2003 Krouss
2003/0179258 A1 * 9/2003 Freire et al.

* cited by examiner

X MISPLACEMENT = {GAP*CARRIER VELOCITY/JETVELOCITY*cos(Theta) ]}+GAP*tan(theta)*cos(phi)+>offset Y MISPLACEMENT = GAP*tan(theta)*sin(phi)+yoffset

GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | 0.25 | 0 | 0.25 | |
| Phi (DEGREES) | 270 | 270 | 270 | 270 | |
| X MISPLACEMENT (MICRONS) | 60 | 83.33413 | -60 | -83.33413 | OUPUTS |
| Y MISPLACEMENT (MICRONS) | 0 | -4.363351 | 0 | -4.363351 | |

L2R

R2L

L2R

R2L

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | 0.7 | 0 | 0.7 | |
| Phi (DEGREES) | 180 | 180 | 180 | 180 | |
| X MISPLACEMENT (MICRONS) | 60 | 71.12164 | -60 | -95.55747 | OUPUTS |
| Y MISPLACEMENT (MICRONS) | 0 | 1.5E-15 | 0 | 1.5E-15 | |

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | 0.7 | 0 | 0.7 | |
| Phi (DEGREES) | 180 | 180 | 180 | 180 | |
| X MISPLACEMENT (MICRONS) | 60 | 95.55747 | -60 | -71.12164 | OUPUTS |
| Y MISPLACEMENT (MICRONS) | 0 | -1.5E-15 | 0 | -1.5E-15 | |

L2R

R2L

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | 0.7 | 0 | 0.7 | |
| Phi (DEGREES) | 180 | 180 | 180 | 180 | |
| X MISPLACEMENT (MICRONS) | 60 | 71.12164 | -60 | -95.55747 | OUPUTS |
| Y MISPLACEMENT (MICRONS) | 0 | 1.5E-15 | 0 | 1.5E-15 | |

L2R

R2L

L2R

R2L

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | -0.7 | 0 | -0.7 | |
| Phi (DEGREES) | 180 | 180 | 180 | 180 | |
| X MISPLACEMENT (MICRONS) | 60 | 95.55747 | -60 | -71.12164 | OUPUTS |
| Y MISPLACEMENT (MICRONS) | 0 | -1.5E-15 | 0 | -1.5E-15 | |

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 1 | 1 | 1 | 1 | |
| Phi (DEGREES) | 180 | 180 | 180 | 180 | |
| X MISPLACEMENT (MICRONS) | 42.55407 | 65.89096 | -77.4642 | -100.8011 | OUPUTS |
| Y MISPLACEMENT (MICRONS) | 2.14E-15 | 2.14E-15 | 2.14E-15 | 2.14E-15 | |

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | -1 | -1 | -1 | -1 | |
| Phi (DEGREES) | 180 | 180 | 180 | 180 | |
| X MISPLACEMENT (MICRONS) | 77.4642 | 100.8011 | -42.55407 | -65.89096 | OUPUTS |
| Y MISPLACEMENT (MICRONS) | -2.14E-15 | -2.14E-15 | -2.14E-15 | -2.14E-15 | |

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | -2.5 | 0 | -2.5 | |
| Phi (DEGREES) | 0 | 90 | 0 | 90 | |
| X MISPLACEMENT (MICRONS) | 60 | 83.41272 | -60 | -83.41272 | OUPUTS |
| Y MISPLACEMENT (MICRONS) | 0 | -43.66094 | 0 | -43.66094 | |

L2R

R2L

L2R

R2L

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED

| | |
|---|---|
| GAP (MICRONS) | 1000 |
| CARRIER VELOCITY (ips) | 30 |

| | L2R | | R2L | | |
|---|---|---|---|---|---|
| | MAIN | SATELLITE | MAIN | SATELLITE | |
| JET VELOCITY (ips) | 500 | 360 | 500 | 360 | INPUTS |
| Theta (DEGREES) | 0 | 2.5 | 0 | 2.5 | |
| Phi (DEGREES) | 0 | 90 | 0 | 90 | |
| X MISPLACEMENT (MICRONS) | 60 | -83.41272 | -60 | 83.41272 | OUPUTS |
| Y MISPLACEMENT (MICRONS) | 0 | 43.66094 | 0 | 43.66094 | |

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED
GAP (MICRONS) 1000
CARRIER VELOCITY (ips) 30

| | L2R MAIN 1 | SAT 1 | L2R MAIN 2 | SAT 2 | L2l MAIN 1 | SAT 1 | R2l MAIN 2 | SAT 2 |
|---|---|---|---|---|---|---|---|---|
| JET VELOCITY (ips) | 500 | 360 | 500 | 300 | 500 | 300 | 500 | 360 |
| Theta (DEGREES) | 0 | 0 | 0 | 0 | 0 | 0 | 0 | 0 |
| Phi (DEGREES) | 0 | 180 | 0 | 180 | 0 | 180 | 0 | 180 |
| X MISPLACEMENT (MICRONS) | 80 | 103.3333 | 40 | 80 | -40 | -80 | -80 | -103.3333 |
| x OFFSET | 20 | 20 | -20 | -20 | 20 | 20 | -20 | -20 |
| Y MISPLACEMENT (MICRONS) | 0 | 0 | 0 | 0 | 0 | 0 | 0 | 0 |
| y OFFSET | 0 | 0 | 0 | 0 | 0 | 0 | 0 | 0 |

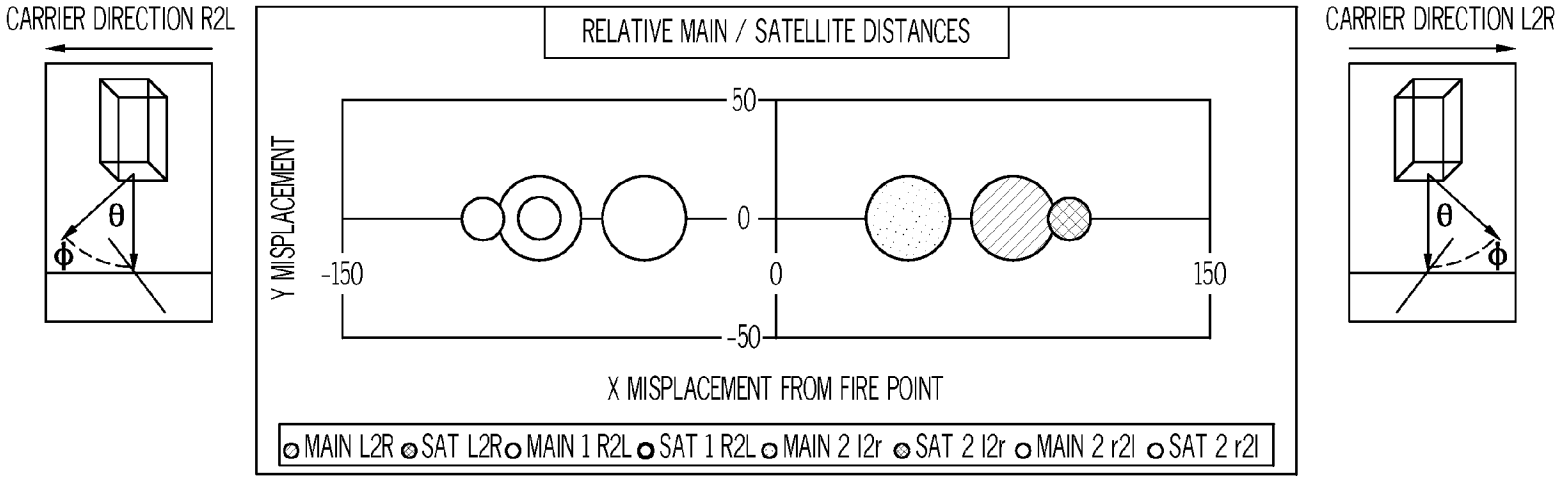

FIG. 21

X MISPLACEMENT = {GAP*CARRIER VELOCITY/JETVELOCITY*cos(Theta) ]}+GAP*tan(theta)*cos(phi)+>offset
Y MISPLACEMENT = GAP*tan(theta)*sin(phi)+yoffset
GRAVITY AND AIR TURBULENCE IGNORED
GAP (MICRONS) 1000
CARRIER VELOCITY (ips) 30

| | L2R MAIN 1 | SAT 1 | L2R MAIN 2 | SAT 2 | L2I MAIN 1 | SAT 1 | R2I MAIN 2 | SAT 2 |
|---|---|---|---|---|---|---|---|---|
| JET VELOCITY (ips) | 500 | 360 | 500 | 300 | 500 | 300 | 500 | 360 |
| Theta (DEGREES) | 0 | 0 | 0 | 0 | 0 | 0 | 0 | 0 |
| Phi (DEGREES) | 0 | 180 | 0 | 180 | 0 | 180 | 0 | 180 |
| X MISPLACEMENT (MICRONS) | 60 | 83.3333 | 60 | 83.3333 | -60 | -83.3333 | -60 | -83.3333 |
| x OFFSET | 0 | 0 | 0 | 0 | 0 | 0 | 0 | 0 |
| Y MISPLACEMENT (MICRONS) | 70 | 70 | -70 | -70 | 70 | 70 | -70 | -70 |
| y OFFSET | 70 | 70 | -70 | -70 | 70 | 70 | -70 | -70 |

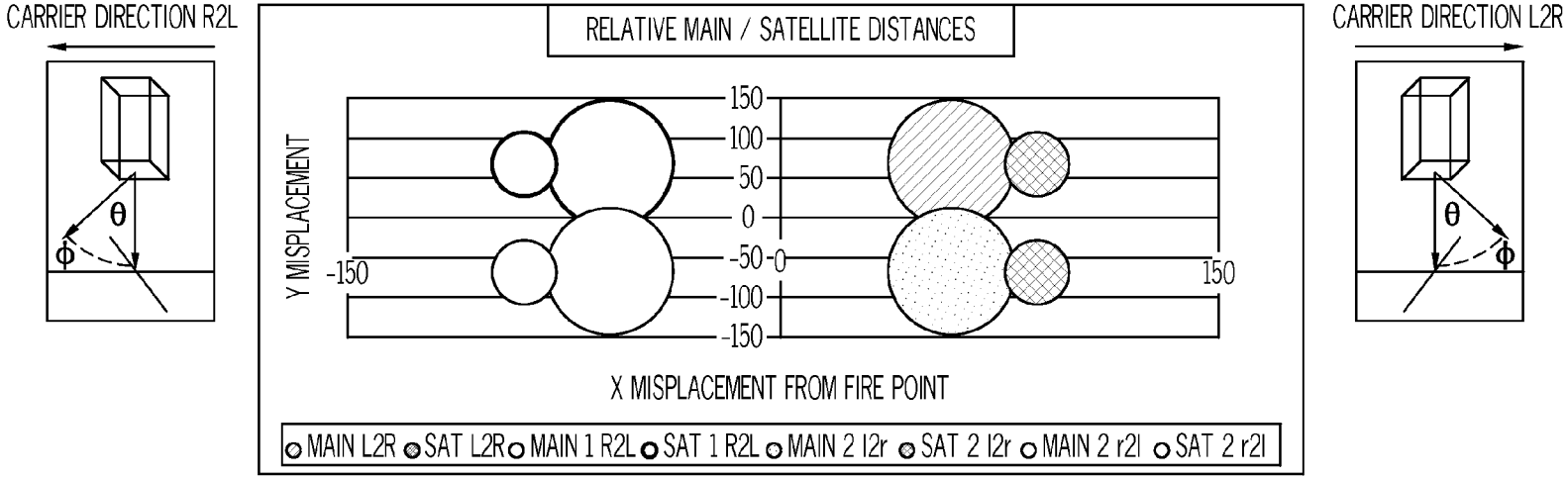

FIG. 23

BALANCED SATELLITE DISTRIBUTIONS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to printers. More particularly, the present invention relates to ink jet printers.

2. General Background of the Invention

High quality ink jet printing is usually done in one direction (unidirectional) and in multiple passes to hide repetitive defects in dot placement. For each firing of an ink jet nozzle there may be more than one drop, a main drop and one or more accompanying satellite droplets. These satellite droplets are generally smaller than the main drop and are at varying distance and direction from the main drop.

Prior art has attempted to reduce or eliminate satellite drops with varying degrees of success. This is usually done by controlling the drive signal to the resistive heater element or piezo-electric element. There is also some prior art for edge-feed thermal ink jet to compensate for topography of the nozzle plate near the edge of the silicon substrate. This prior art typically does not mention controlling satellites, but is concerned with the main drop misdirection.

One of ordinary skill in this art should be able to find details of the invention not specifically disclosed herein in, for example, patents and other references and prior art products mentioned herein.

The following patents are believed to be related to the first embodiment of the present invention: U.S. Patent Document Nos.:

4,282,533; 5,406,318; 5,867,189; 6,126,282; 6,247,794; 6,264,850; 6,293,644; 6,299,281; 6,336,710; 6,491,833; 6,505,912; 6,527,354.

The following patent documents are believed to be related to the second embodiment of the present invention: U.S. Patent Document Nos.:

5,896,154; 6,250,739; 6,367,908; 2002/0054187; 2003/0025749; 6,491,377; 6,505,905 (same application as 2003/0025749); U.S. Pat. No. 6,527,376

The following patent documents are believed to be related to the third embodiment of the present invention: U.S. Patent Document Nos.:

5,859,653; 5,870,117; 6,053,598; 6,302,505; 6,302,506; 6,464,330; 6,497,467; 6,523,926; 6,530,635; 6,536,869

The following patent documents are believed to be related to the fourth embodiment of the present invention: U.S. Patent Document Nos.:

3,976,756; 4,048,639; 4,246,589; 4,380,017; 4,384,296; 5,142,296; 5,638,101; 6,220,693; 6,491,377.

Japanese patent document no. JP358217372A.

The following patent documents are believed to be related to the fifth embodiment of the present invention: U.S. Patent Document Nos.:

3,928,855; 4,613,875; 5,337,071; 6,220,693; 6,276,783; 6,293,644; 6,338,545; 6,364,447

The following patent documents are believed to be related to the sixth embodiment of the present invention: U.S. Patent Document Nos.:

3,981,019; 4,220,958; 4,238,804; 4,393,385; 4,555,712; 4,638,337; 4,827,280; 5,396,273; 5,422,664.

U.S. Pat. Nos. 5,049,899 and 6,474,763 are also believed to be of interest.

BRIEF SUMMARY OF THE INVENTION

The apparatus of the present invention comprises an inkjet printer, a system for printing, and a method of printing using an inkjet printhead having specially shaped and/or directed nozzle bores to control the distribution of main and/or satellite ink drops.

The method of printing of the present invention includes intentional directional shifting of satellites for uniform density control.

The apparatus of the present invention includes a printhead for an inkjet printer, the printhead comprising an ink reservoir and nozzles for ejecting ink from the ink reservoir onto print media, the nozzles being formed in the ink jet printer printhead in a predetermined fashion with bores purposefully shaped and/or directed to determine the formation and placement of satellite droplets when ink is ejected from the ink reservoir when the printhead is part of an inkjet printer.

In some embodiments: (a) each of the nozzles produces a main drop and a satellite droplet when ink is ejected through the nozzles, (b) each nozzle includes a bore, (c) the bore of each nozzle is shaped such that, when ink is ejected through the nozzles, satellite droplets and main drops are balanced—the combined area of satellite droplet and main drop in a first printing direction is as nearly equal as possible to the combined area of the satellite droplet and main drop in a second printing direction opposite to the first printing direction; this can be achieved, for example, by forming the bores as truncated vertical cones, with each bore including two concentric circles, a larger one at the top, a smaller one at the bottom with the two concentric circles connected by a conical section, and the vertical axis through the conical section being substantially normal to the surface of the nozzle plate; (d) the printhead is used in a printer which prints in two directions, and (e) when ink is ejected through the nozzles, satellite droplets and main drops are balanced—the combined area of satellite droplet and main drop in a first printing direction is as nearly equal as possible to the combined area of the satellite droplet and main drop in a second printing direction opposite to the first printing direction; when ink is ejected through the nozzles, satellite droplets ejected through the nozzles can at least partially overlap the main drops in each direction of printing.

In some embodiments:

(a) each of the nozzles produces a main drop and a satellite droplet when ink is ejected through the nozzles,
(b) each nozzle includes a bore,
(c) each bore has an axis,
(d) a first plurality of the nozzles have the axes of their bores aligned in a first direction,
(e) a second plurality of the nozzles have the axes of their bores aligned in a second direction, and (f) when ink is ejected through the nozzles, satellite droplets ejected through the first plurality of the nozzles are offset from the main drops ejected through the first plurality of the nozzles in a different direction from which satellite droplets ejected through the second plurality of the nozzles are offset from the main drops ejected through the second plurality of the nozzles. This produces dots with nearly equal areas in both printing directions, however, in order to produce a straight line, the firing of nozzles directed in one direction must be corrected to nozzles directed in the other direction, since both main drop and satellite drop are directed.

In some embodiments:

(a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) when ink is ejected through the nozzles, each of the satellite droplets ejected through the first plurality of the nozzles is offset from the main drop ejected through the first plurality of the nozzles in substantially the same direction and at substantially the same distance; each of the satellite droplets ejected can for example fall within the area of a main drop, thus producing no additional satellite droplets on the media; the inkjet print head can for example travel laterally while printing, and the satellite droplets can for example be laterally offset from the main drops, or the satellite droplets can for example be vertically offset from the main drops. When the satellite droplets are vertically offset from the main drops, the satellite droplets can for example be directed vertically enough to be separated from the main drop on the media; printing laterally in either direction can for example produce main drops and satellite droplets with nearly equal combined areas on the media. Since nozzles are all directed in the same direction, no electronic firing compensation is needed to produce a line. This causes improved uniform density in both bi-directional and uni-directional print modes.

In some embodiments:

(e) a second plurality of the nozzles have their axes of their bores aligned in a second direction, (f) when ink is ejected through the nozzles, satellite droplets ejected through the first plurality of the nozzles are offset from the main drops ejected through the first plurality of the nozzles in a different direction from which satellite droplets ejected through the second plurality of the nozzles are offset from the main drops ejected through the second plurality of the nozzles.

In some embodiments the inkjet printer includes means for printing in a single lateral direction so that the main drop and satellite droplet at least partially overlap.

In some embodiments the bores are aligned so that the main drop and satellite droplet ejected from substantially all of the nozzles at least partially overlap when the printer prints.

In some embodiments:

(a) each of the nozzles produces a main drop and a satellite droplet when ink is ejected through each nozzle at a fire point, (b) each nozzle includes a bore, (c) each bore has an axis, (d) a first plurality of the nozzles have the axes of their bores aligned in a first direction, (e) a second plurality of the nozzles have the axes of their bores aligned in a second direction, (f) when ink is ejected through the nozzles, the main drops ejected through the first plurality of the nozzles are offset in a different direction from the fire point from which main drops ejected through the second plurality of the nozzles are offset from the fire point.

In some embodiments:

(a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) a second plurality of the nozzles have the axes of their bores aligned in a second direction, (f) a heater is used to eject ink through the nozzles, and each heater ejects ink through a first nozzle from the first plurality of nozzles and a second nozzle from the second plurality of nozzles, (g) the nozzles are aligned and directed such that when ink is ejected through the nozzles, satellite droplets ejected through the first plurality of the nozzles are offset from the main drops ejected through the first plurality of the nozzles in a different direction from which satellite droplets ejected through the second plurality of the nozzles are offset from the main drops ejected through the second plurality of the nozzles, such that:

in a first direction of printing, the main drop from the first nozzle associated with a heater at least partially overlaps the satellite droplet from that nozzle and at least partially overlaps the satellite droplet from the second nozzle associated with that heater, and in a second direction of printing, the main drop from the second nozzle associated with a heater at least partially overlaps the satellite droplet from that nozzle and at least partially overlaps the satellite droplet from the first nozzle associated with that heater.

The nozzle bores can for example be oriented such that they eject ink opposite the direction of travel of the print head when the print head is moving and printing.

The present invention includes an inkjet print head comprising the inkjet print head chip, and an ink jet printer comprising the inkjet print head.

The nozzle bores can for example be formed in polyimide film; the nozzle bores can for example be cut with an eximer laser.

The present invention includes a method of controlling the formation and placement of satellite droplets ejected from an ink jet printer printhead comprising the steps of:

providing an ink jet printer printhead having an ink reservoir; forming nozzles in the ink jet printer printhead; installing the printhead in an ink jet printer; ejecting ink from the reservoir through the nozzles in the form of main drops and satellite droplets in a manner to achieve uniform density control by controlling the formation and placement of satellite droplets when ink is ejected from the reservoir of the ink jet printer printhead when the printhead is part of an inkjet printer. The method of the present invention can advantageously use the apparatus of the present invention.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 21 shows calculations to determine offset of the satellites from the main drops fired from two nozzle bores per heater laterally offset from one another, one of the bores being similar to that shown in FIGS. 1A–1C, the other being similar to that shown in FIGS. 2A–2C, such that in each printing direction one main drop both touches its main satellite droplet and overlaps the other main satellite droplet from the other main drop, and it shows the calculated placement of the main and satellite droplets;

FIG. 23 shows calculations to determine offset of the satellites from the main drops fired from two nozzle bores per heater vertically offset from one another, the bores being similar to that shown in FIGS. 3A–3C, and it shows the calculated placement of the main and satellite droplets;

DETAILED DESCRIPTION OF THE INVENTION

Balanced Satellite Distributions

Figure 1A:
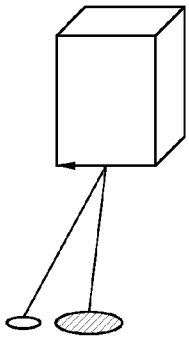
FIG. 1A–1C are schematic views of an inkjet nozzle bore which is angled to the left (FIG. 1C), causing satellite droplets to be spaced from the main drop when the print head is moving in the right to left direction (FIG. 1A), and causing satellite droplets to at least partially overlap the main drop when the print head is moving in the left to right direction (FIG. 1B)
Figure 1B:
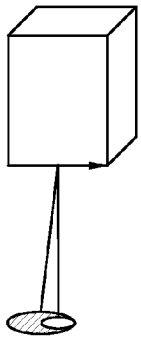
Figure 1C:
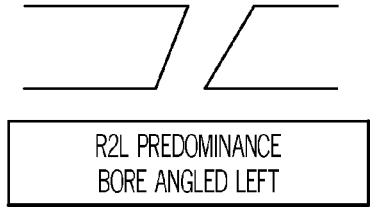
Figure 2A:
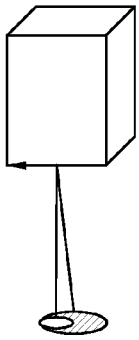
FIGS. 2A–2C are schematic views of an inkjet nozzle bore which is angled to the right (FIG. 2C), causing satellite droplets to at least partially overlap the main drop when the print head is moving in the right to left direction (FIG. 2A), and causing satellite droplets to be spaced from the main drop when the print head is moving in the left to right direction (FIG. 2B)
Figure 2B:
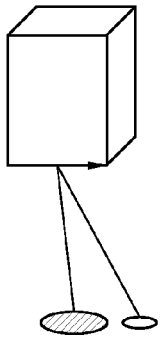
Figure 2C:
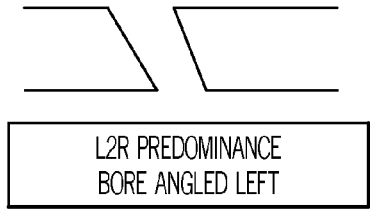
Figure 3A:
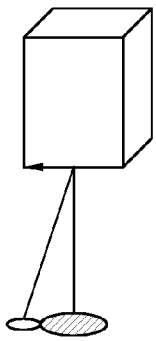
FIGS. 3A–3C are schematic views of an inkjet nozzle which has a balanced bore (FIG. 3C), causing satellite droplets to at least partially overlap the main drop when the print head is moving in the right to left direction (FIG. 3A), and also causing satellite droplets to at least partially overlap the main drop when the print head is moving in the left to right direction (FIG. 3B); the overlapping of drops is not essential to this embodiment of the present invention—it is sufficient that the bore be balanced enough to cause satellite droplets to be spaced from the main drop when the print head is moving in the right to left direction at approximately the same distance as satellite droplets are spaced from the main drop when the print head is moving in the left to right direction.
Figure 3B:
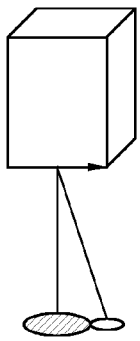
Figure 3C:
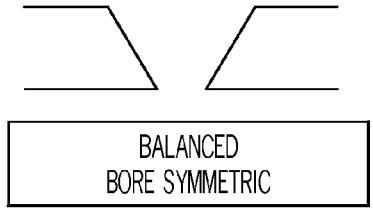
Figure 4A:
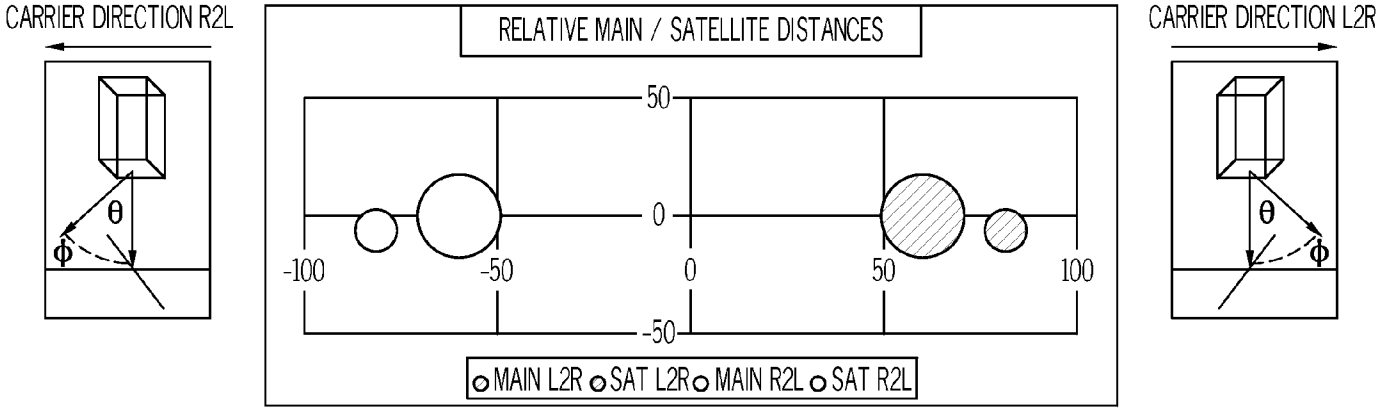
FIG. 4 shows calculations to determine offset of the satellite droplet from the main drop in the balanced nozzle bore shown in FIGS. 3A–3C, shows the calculated placement of the main drops and satellite droplets, and shows that actual placement of the main drops and satellite droplets in the left to right direction and in the right to left direction when fired from the balanced nozzle bore shown in FIGS. 3A–3C.
Figure 4B:
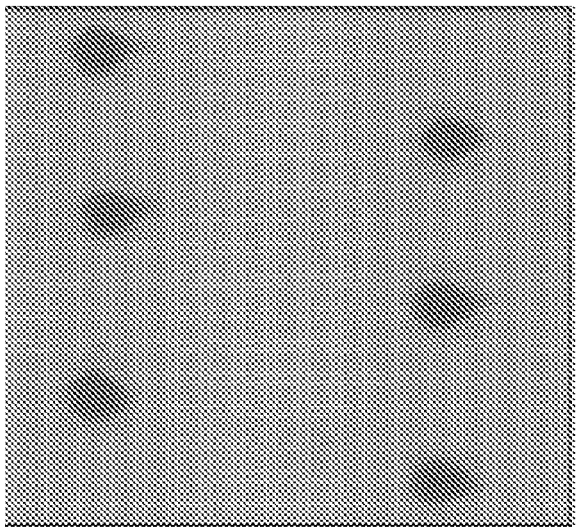
Figure 4C:
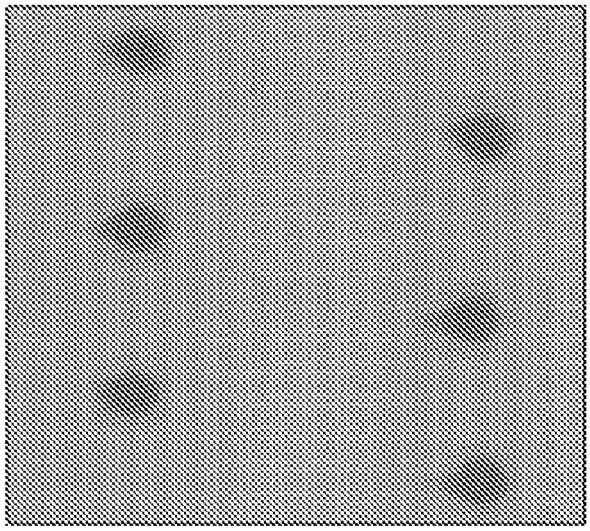
Figure 5A:
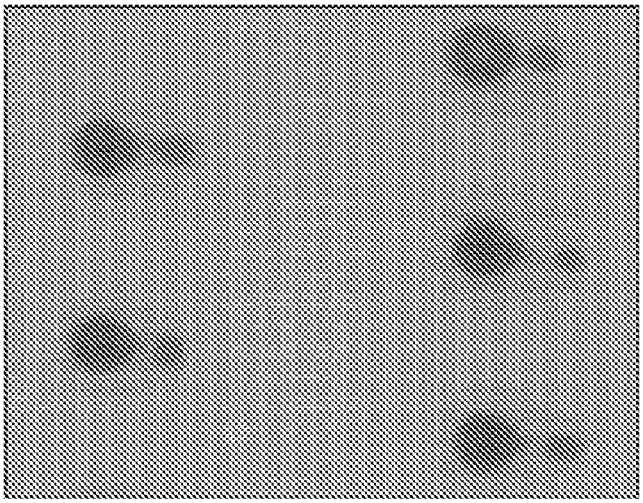
FIG. 5 shows actual placement of the main drops and satellite droplets in the left to right direction when fired from the nozzle bore shown in FIGS. 2A–2C and in the right to left direction when fired from the nozzle bore shown in FIGS. 1A–1C.
Figure 5B:
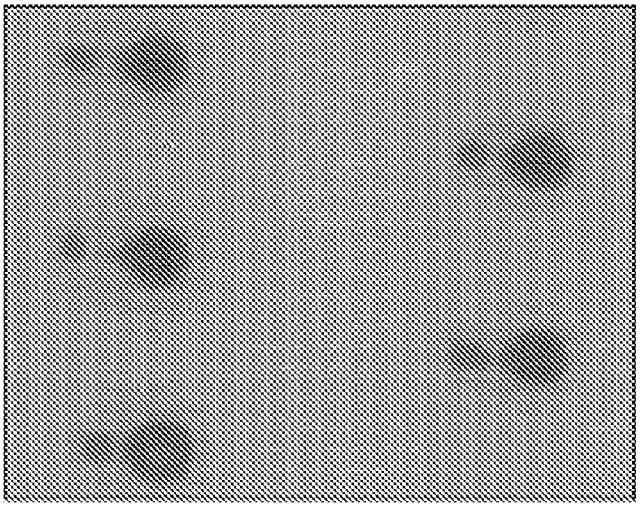
Figure 6:
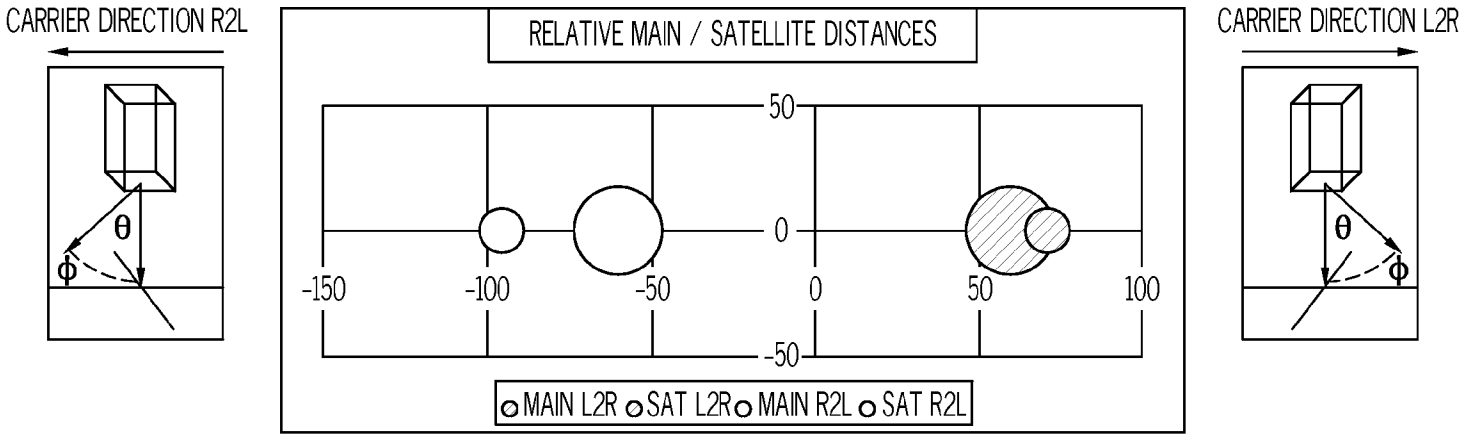
FIG. 6 shows calculations to determine offset of the satellite from the main drop in the nozzle bore shown in FIGS. 1A–1C, and shows the calculated placement of the main and satellite drops in the right to left direction and in the left to right direction when fired from the nozzle bore shown in FIGS. 1A–1C.
Figure 7:
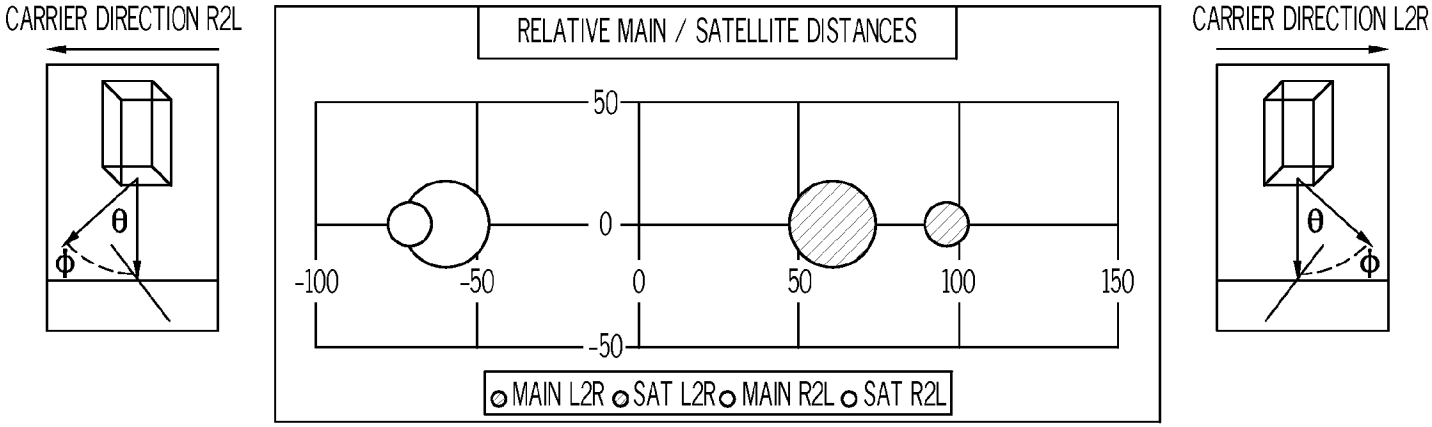
FIG. 7 shows calculations to determine offset of the satellite from the main drop in the nozzle bore shown in FIGS. 2A–2C, and shows the calculated placement of the main and satellite droplets in the right to left direction and in the left to right direction when fired from the nozzle bore shown in FIGS. 2A–2C.

In the first embodiment of the present invention the nozzle openings are formed with a balanced bore (see FIG. 3C) to cause satellite droplets to be spaced from the main drop when the print head is moving in the right to left direction at approximately the same distance as satellite droplets are spaced from the main drop when the print head is moving in the left to right direction; in FIGS. 3A, 3B, and 3C, the nozzle bores are formed such that the satellite ink drops touch the main drops in both directions of printing (see FIGS. 3A and 3B).

It is the distance and direction of the satellite droplet from the main drop that the first embodiment of the present invention proposes to control. By controlling this distance and direction one can reduce the repetitive differences between printing right-to-left and printing left-to-right. High quality ink jet printing in two directions (bi-directionally) reduces the printing time by half.

Satellite steering is caused by the bore angle of the nozzle hole with respect to the silicon substrate surface (see FIGS. 1A–3C).

A bore angled to the left causes satellite predominance in the R2L direction (see FIGS. 1A–1C, 5, and 6). A bore angle to the right causes L2R satellite predominance (see FIGS. 2A–2C, 5, and 7). Satellite location with respect to the main dot depends on a number of factors that will be detailed below. Maximum allowable angle for a balanced satellite distribution depends on the drop velocity, carrier velocity, and paper gap. Gravity and air turbulence are ignored and have been found to be negligible in practice.

Once the printhead gap and drop velocities are known along with the associated tolerances for each, one can calculate the angular tolerance needed to maintain a balanced satellite pattern.

Balanced satellite distributions R2L and L2R create print swaths of uniform color and density (see FIGS. 3A–3C and FIG. 4). High quality printing in both directions (bi-directional) can be achieved when satellite distributions are balanced. This achievement allows doubling the print speed of the printer.

Alternating High Frequency Satellite Direction

Figure 8A:
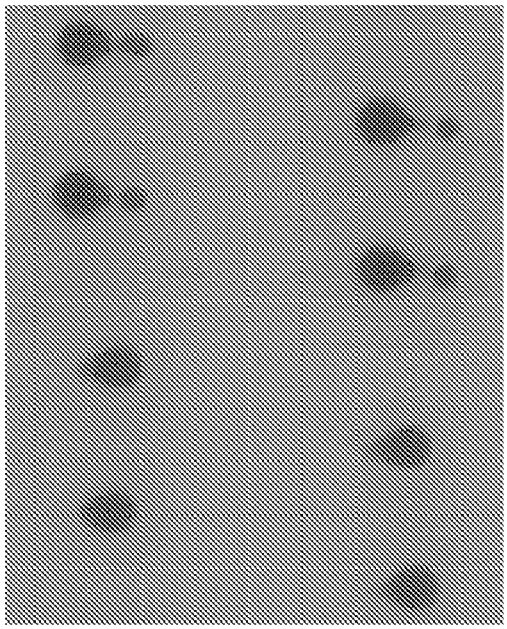
FIG. 8 shows actual placement of the main and satellite droplets when fired from multiple nozzles, where four nozzles are aligned vertically, the top two nozzles have a bore as shown in FIGS. 2A–2C, and the bottom two nozzles have a bore as shown in FIGS. 1A–1C.
Figure 8B:
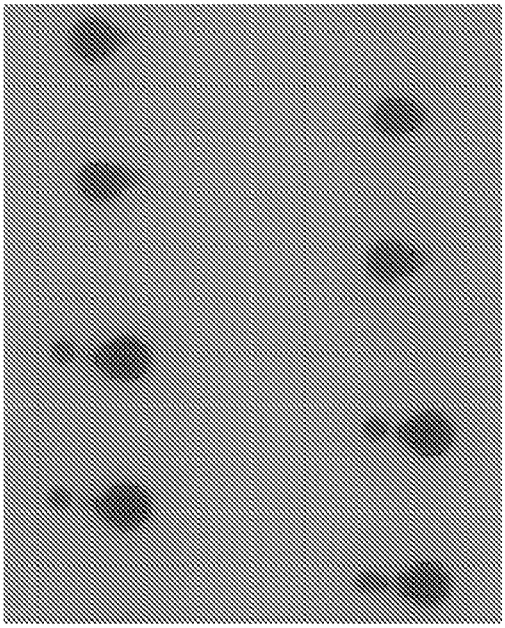

In the second embodiment of the present invention the nozzle openings are formed with all bores in one pair of rows facing to the left, then all bores in the next pair of rows facing to the right, to cause the printing pattern in one direction (e.g, left to right) to be a vertically offset mirror image of the printing pattern in the other direction (i.e, the satellite ink drops are spaced from the main drops in one pair of rows in one direction at approximately the same distance as the satellite ink drops are spaced from the main drops in the next pair of rows in the other direction (see FIG. 8)); in FIG. 8, the satellite ink drops touch the main drops in every other pair of rows in both directions of printing.

It is the distance and direction of the satellite droplet from the main drop that the second embodiment of the present invention proposes to control. By controlling this distance and direction one can reduce the repetitive differences between printing right-to-left and printing left-to-right.

Here it is the intent to purposefully change the satellite direction at some high frequency in the y-direction (printhead swath width). This means that every pair of nozzles or every (1 . . . n) nozzles, have satellites directed in one print direction only. The next pair of nozzles or set of (1 . . . n) nozzles has satellites directed in the opposite direction.

By directing multiples of satellites in opposite directions, one can achieve the same effect as balancing satellites R2L and L2R. High quality bi-directional printing can be achieved with a 2× increase in speed.

Once the printhead gap and drop velocities are known along with the associated tolerances for each, one can calculate the angular tolerance needed to maintain the directed satellite pattern.

Directed satellite distributions R2L and L2R create print swaths of uniform color and density. High quality printing in both directions (bi-directional) can be achieved when satellite distributions are directed at some high frequency (1 . . . n)/dpi. This achievement allows doubling the print speed of the printer.

Elimination of Satellites in One Printing Direction

Figure 9A:
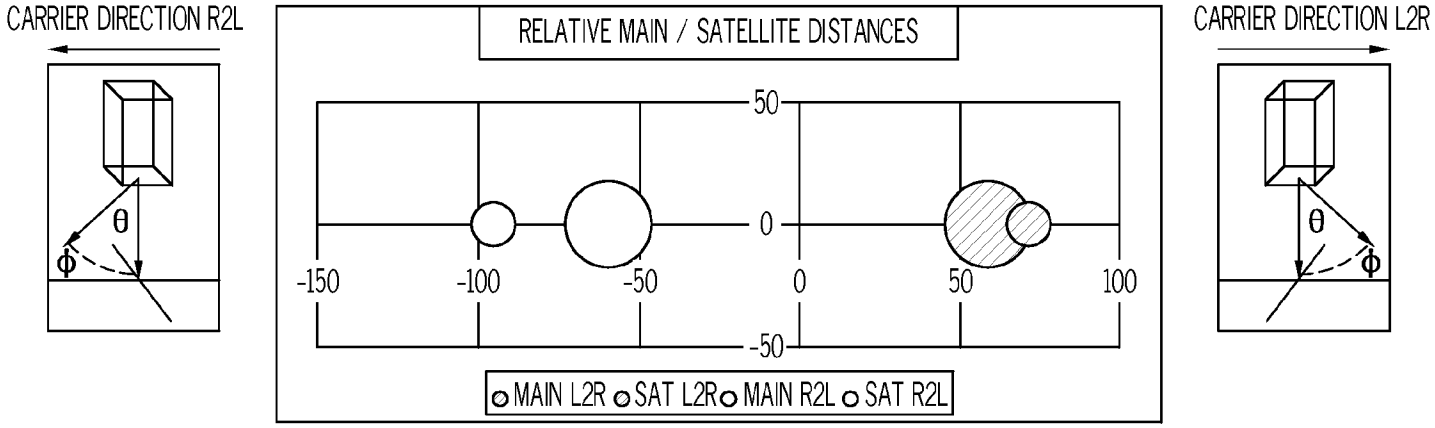
FIG. 9 shows calculations to determine offset of the satellite from the main drop in the nozzle bore shown in FIGS. 1A–1C, shows the calculated placement of the main and satellite droplets, and shows that actual placement of the main and satellite droplets in the left to right direction and in the right to left direction when fired from the nozzle bore shown in FIGS. 1A–1C.
Figure 9B:
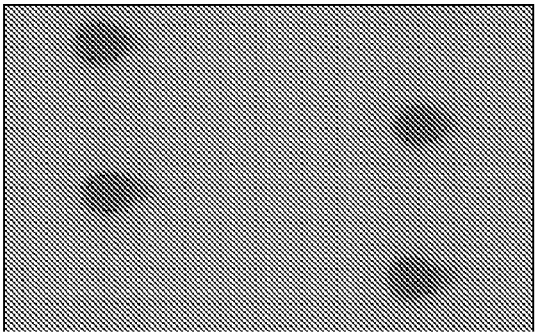
Figure 9C:
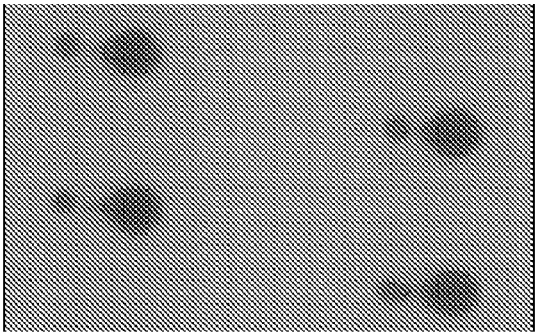
Figure 10B:
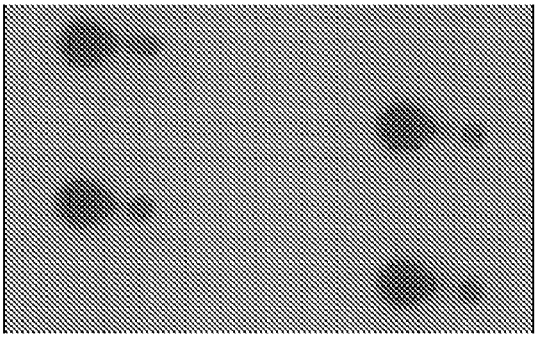
FIG. 10 shows calculations to determine offset of the satellite from the main drop in the nozzle bore shown in FIGS. 2A–2C, shows the calculated placement of the main and satellite droplets, and shows that actual placement of the main and satellite droplets in the left to right direction and in the right to left direction when fired from the nozzle bore shown in FIGS. 2A–2C.
Figure 10C:
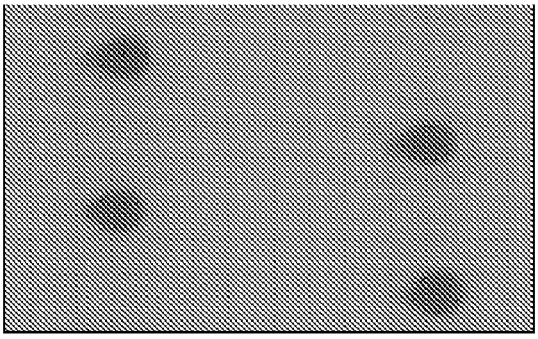
Figure 10A:
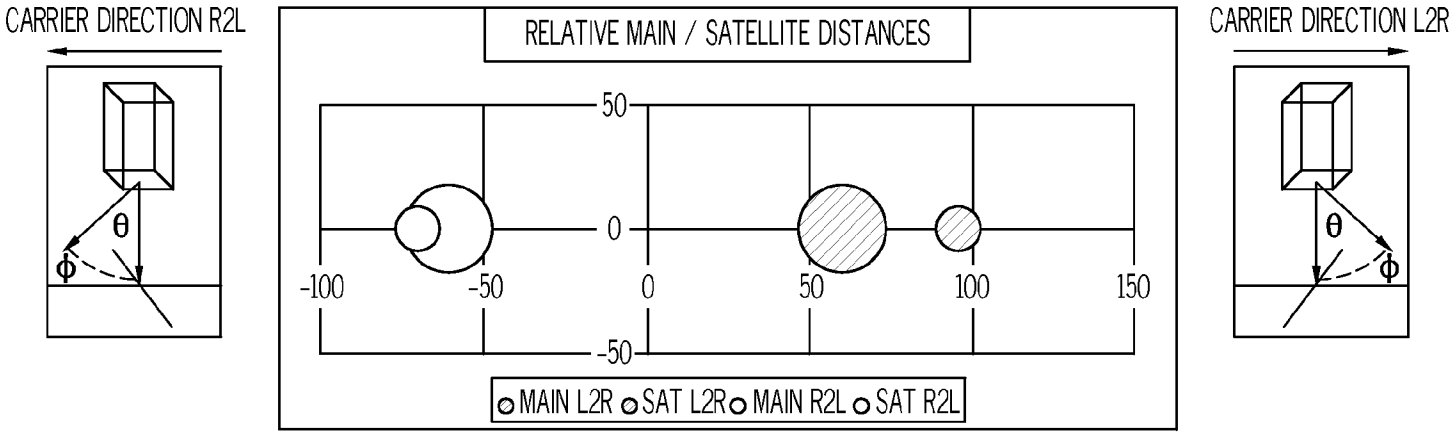

In the third embodiment of the present invention (see FIGS. 9 and 10) the nozzle openings are formed such that all bores face to the left (FIG. 9) or to the right (FIG. 10), so that in one direction there are no satellites (as all the satellites will overlap the main drops). This allows high quality printing if one is willing to print in one direction only (thus doubling the print time).

It is the distance and direction of the satellite droplet from the main drop that the third embodiment of the present invention proposes to control. By controlling this distance and direction one can produce printing in a single direction that is free of satellites. This allows very uniform controlled printing in one direction.

Once the printhead gap and drop velocities are known along with the associated tolerances for each, one can calculate the angular tolerance needed to maintain a predominantly L2R or R2L satellite pattern.

Unidirectional high quality printing can be achieved when satellite distributions are altered using bore angle. This achievement allows excellent control over dot placement and print uniformity.

Steering Main Drops

In the fourth embodiment of the present invention the nozzle openings are formed with all bores in one pair of rows facing to the left, then all bores in the next pair of rows facing to the right, to cause the printing pattern in one direction (e.g, left to right) to be a vertically offset mirror image of the printing pattern in the other direction (i.e, the satellite ink drops are spaced from the main drops in one pair of rows in one direction at approximately the same distance as the satellite ink drops are spaced from the main drops in the next pair of rows in the other direction (very similar to the second embodiment, but in this one the main drops are primarily the ones being directed, while in the second embodiment it is the satellite drops which are primarily the ones being directed).

By controlling the direction of the main drop relative to the desired line of dots one can create a pattern with high frequency or random pattern that will exhibit less defects. This allows very uniform controlled printing in both directions.

Figure 11:
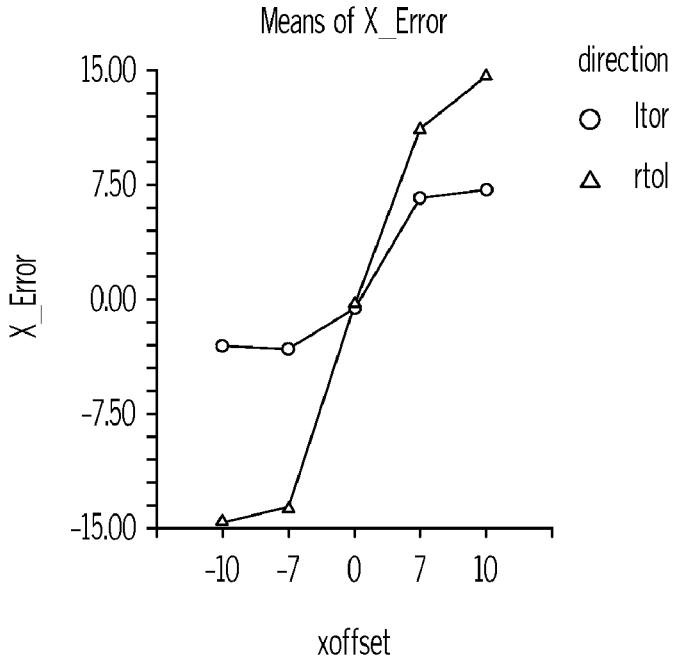
FIG. 11 shows a plot of experimental results with a cyan nozzle offset from the heater in the x-direction, showing the means of x error in a left-to-right direction (circles) and right-to-left direction (triangles)
Figure 12:
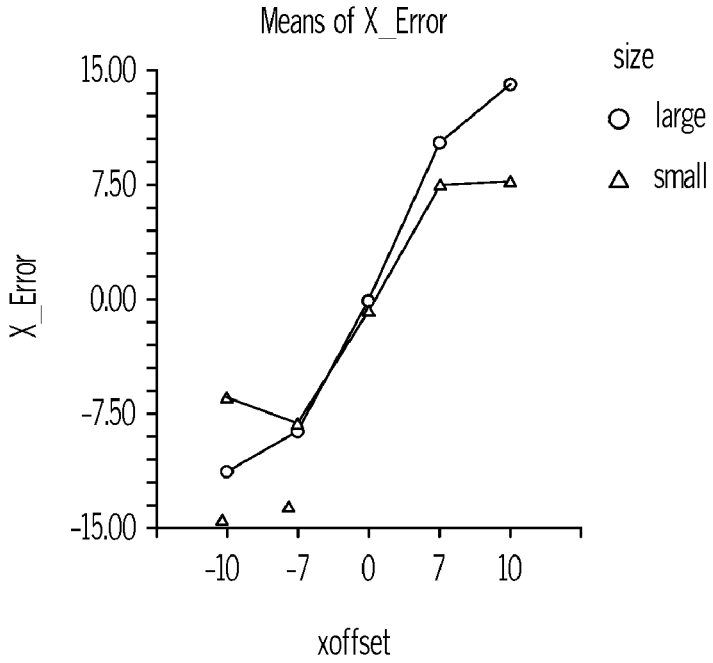
FIG. 12 shows a plot of experimental results with a cyan nozzle offset from the heater in the x-direction, for a printhead with two nozzle sizes showing the means of x error for large nozzles (circles) and small nozzles (triangles) when ejected from a printhead having large and small nozzles, such as for example the Lexmark Part No. 18L0042 printhead (sometimes also called the Lexmark No. 83 printhead)
Figure 13:
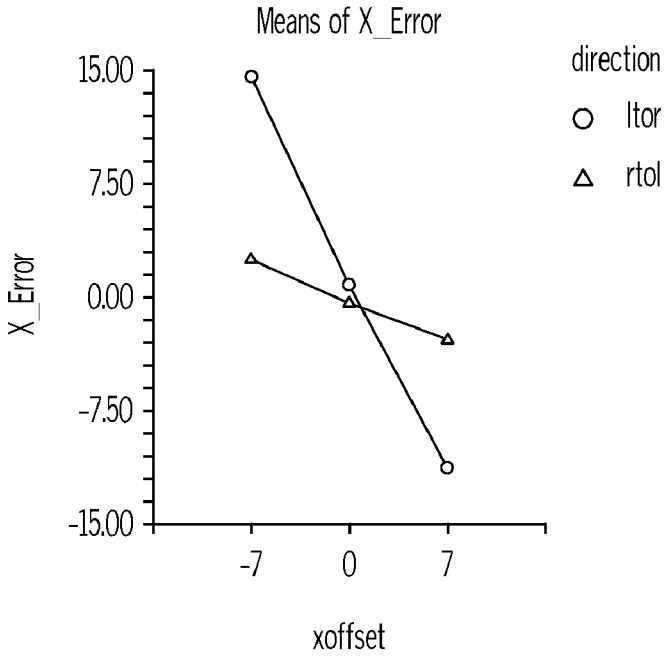
FIG. 13 shows a plot of experimental results with a yellow nozzle offset from the heater in the x-direction, showing the means of x error in a left-to-right direction (circles) and right-to-left direction (triangles)
Figure 14:
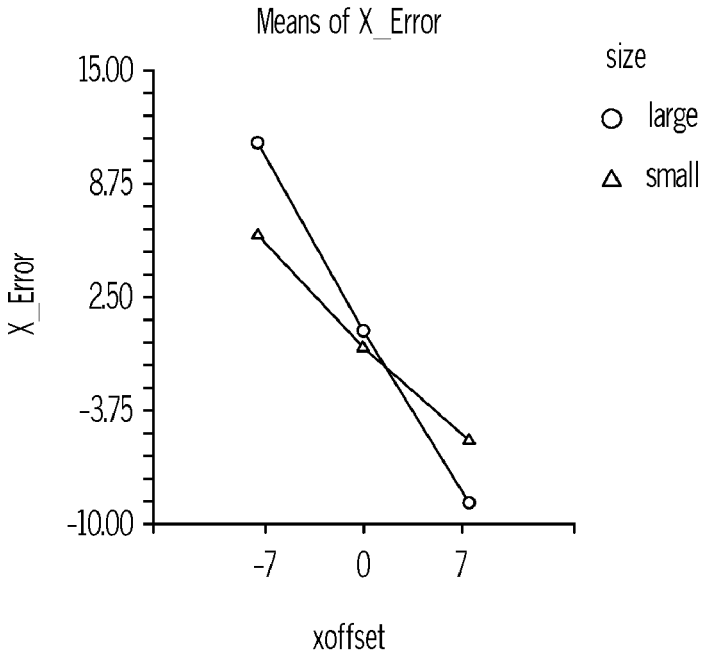
FIG. 14 shows a plot of experimental results with a yellow nozzle offset from the heater in the x-direction, for a printhead with two nozzle sizes showing the means of x error for large nozzles (circles) and small nozzles (triangles)
Figure 15:
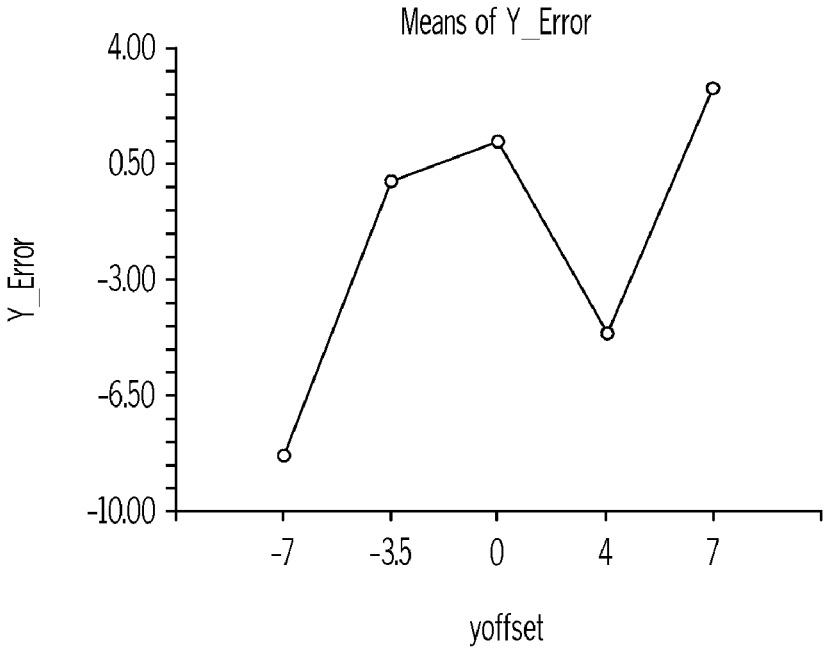
FIG. 15 shows a plot of experimental results of main drops with a nozzle offset from the heater in the y-direction, showing the means of y error.
Figure 16:
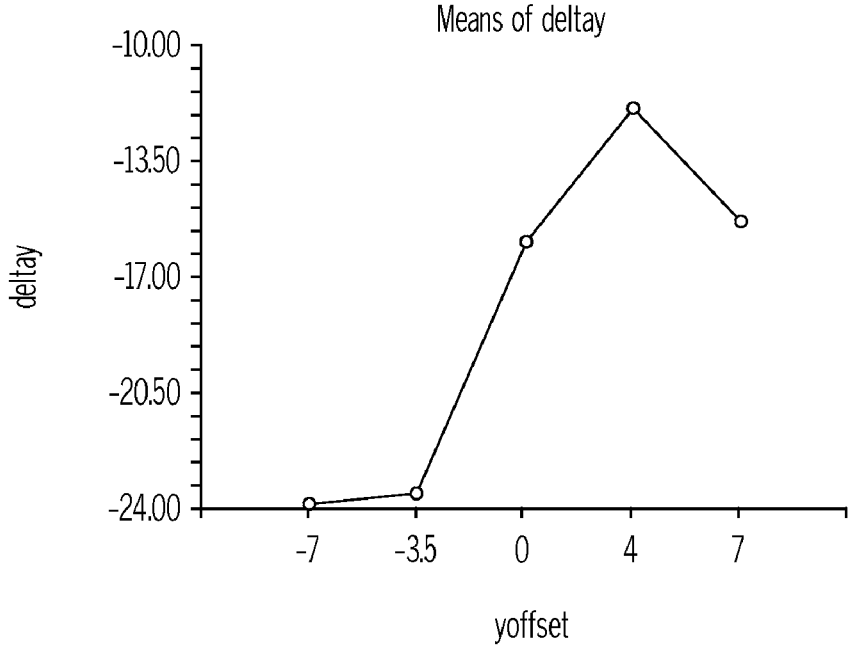
FIG. 16 shows a plot of experimental results of satellite droplets with a nozzle offset from the heater in the x-direction, showing the means of delta y.

Controlling the main drop position relative to the desired in-line firing of nozzles involves offsetting the inkjet nozzle relative to the heater. Change in the main drop position in the x-direction can be accomplished by offsetting the nozzle in the x-direction (see FIGS. 11–14—the reference point was different between the cyan graph (FIGS. 11 and 12) and the yellow graph (FIGS. 13 and 14), consequently the slope is reversed). A change in the main drop position in the y-direction can be accomplished by offsetting the nozzle in the y-direction (see FIGS. 15 and 16).

Figure 17:
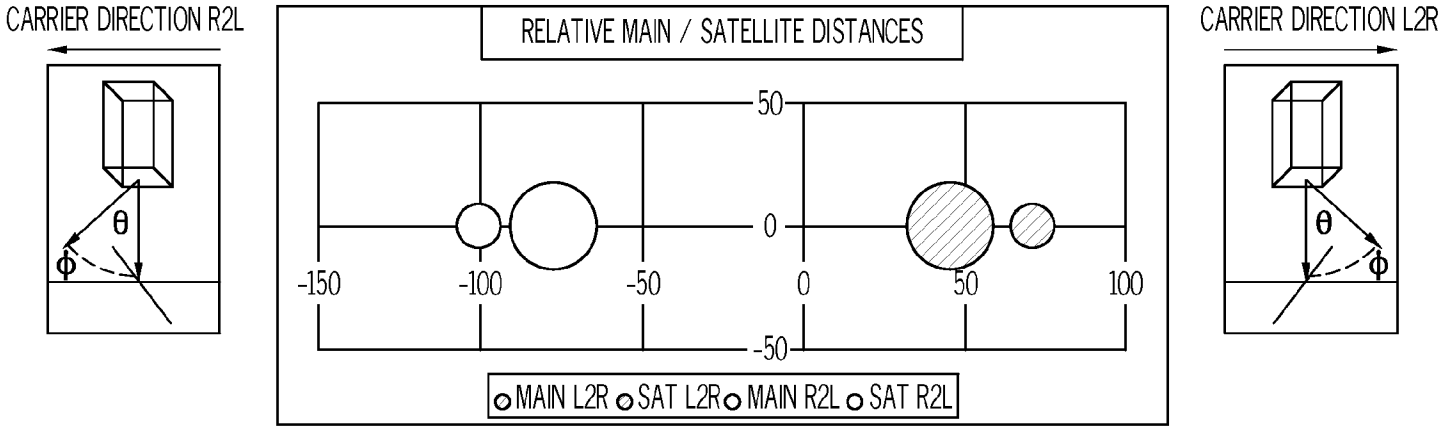
FIG. 17 shows calculations to determine offset of the satellite from the main drop in the nozzle bore similar to that shown in FIGS. 1A–1C, but where the nozzle bore is formed to offset both the main drop and the satellite droplet, and shows the calculated placement of the main and satellite droplets in the right to left direction and in the left to right direction when fired from that nozzle bore.
Figure 18:
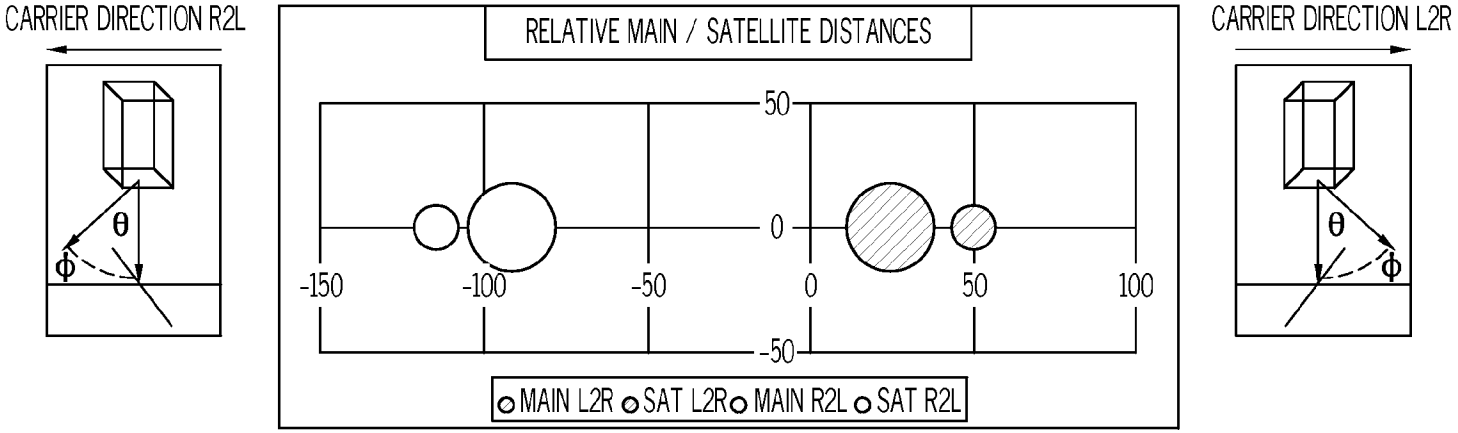
FIG. 18 shows calculations to determine offset of the satellite from the main drop and to determine the nozzle bore characteristics similar to that shown in FIGS. 2A–2C, but where the nozzle bore is formed to offset both the main drop and the satellite droplet, and shows the calculated placement of the main and satellite droplets in the right to left direction and in the left to right direction when fired from that nozzle bore.

In addition to nozzle hole offset, a bore angled to the left causes main drop movement to the left (FIG. 17). A bore angle to the right causes main drop movement to the right (FIG. 18). Main drop location with respect to the fire point depends on a number of factors that will be detailed below. Desired tolerance on bore angle for main drop deflection depends on the drop velocity, carrier velocity, and paper gap. Gravity and air turbulence are ignored and have been found to be negligible in practice.

Once the printhead gap and drop velocities are known along with the associated tolerances for each, one can calculate the angular tolerance needed to maintain main drop deflection to the right or to the left (see FIGS. 17 and 18).

Here it is the intent to purposefully change the main drop direction at some high frequency in the y-direction (printhead swath width). This means that every pair of nozzles or every (1 . . . n) nozzles are directed say to the right. The next pair of nozzles or set of (1 . . . n) nozzles is directed in the opposite direction.

Using Satellites to Fill Swath and Improve Uniformity

In the fifth embodiment of the present invention the nozzle openings are formed with an upwardly or downwardly directed bore to cause the satellite ink drops to be offset in the y direction so one can increase the space between the main drops and still have full coverage.

By controlling the direction of the satellite droplet relative to the main dot one can use the satellite droplets to fill white space between lines of main drops.

In this embodiment reduced print density variation can for example be achieved by directing the satellites in the vertical axis far enough to be separated from the main dot on the print media. This placement ensures that as the carrier moves in either direction the satellite will fall outside the main dot. The result is a consistent ink print coverage and equal density in either direction. This technique is also of benefit to unidirectional printing. Variation in satellite trajectory within the nozzle array can cause some of the satellites to fall within the main dot area and others to fall outside the main dot area. This results in density bands within the printed swath. By directing the satellites sufficiently vertically, the satellites fall outside the main dot area in spite of these trajectory variations and the density of the swath is more uniform. In this method, all nozzles can for example have the same vertical satellite directing applied; thus, if the main drop is affected by the satellite positioning technique, all drops are affected equally thereby requiring no electrical timing compensation for re-alignment. The same effect can be achieved by either directing nozzles up or directing nozzles down.

A nozzle hole bore angled to the left causes main drop movement to the left. A bore angle to the right causes main drop movement to the right. Likewise a bore angled up causes the satellite droplets to land above the main drop (see FIG. 20), just as a bore angled down causes the satellite droplets to land below the main drop (see FIG. 19). Satellite location with respect to the main drop depends on a number of factors that will be detailed below. Desired tolerance on bore angle for satellite droplet deflection depends on the drop velocity, carrier velocity, and paper gap. Gravity and air turbulence are ignored and have been found to be negligible in practice.

Figure 19A:
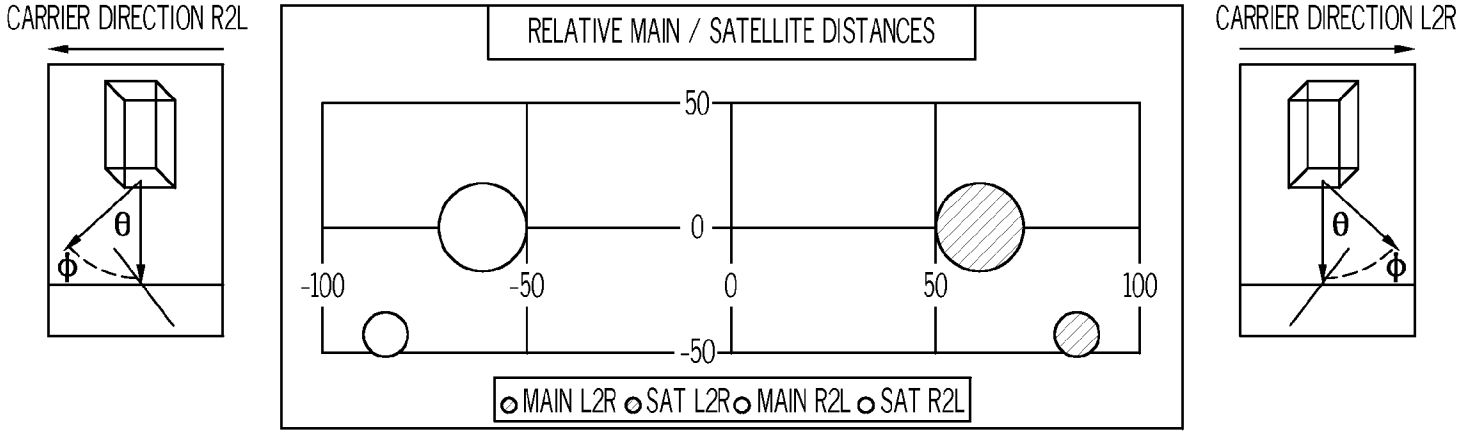
FIG. 19 shows calculations to determine offset of the satellite from the main drop fired from a nozzle bore (not shown) which is offset downward in the y-direction, shows the calculated placement of the main and satellite droplets, and shows that actual placement of the main and satellite droplets in the left to right direction and in the right to left direction when fired from that nozzle bore.
Figure 19B:
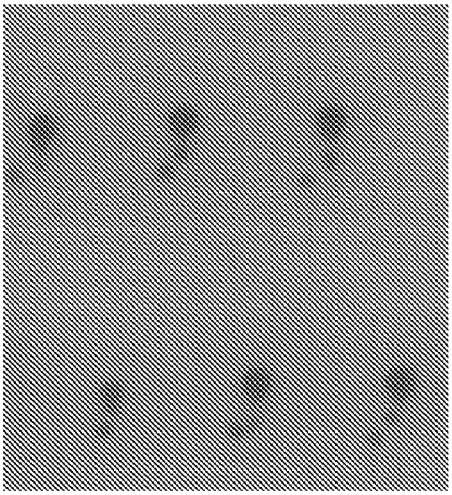
Figure 19C:
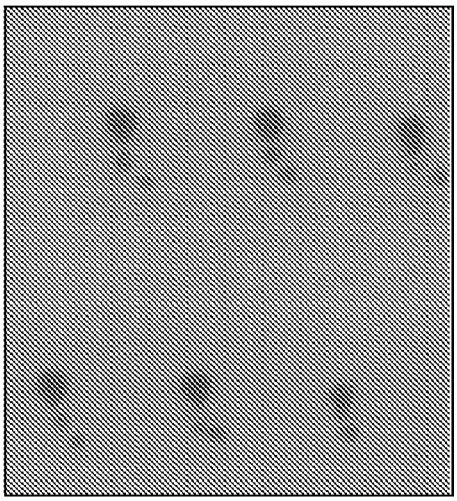
Figure 20B:
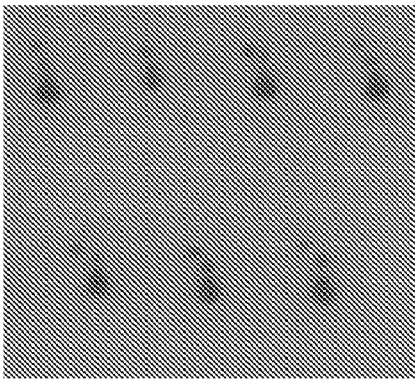
FIG. 20 shows calculations to determine offset of the satellite from the main drop fired from a nozzle bore (not shown) which is offset upward in the y-direction, shows the calculated placement of the main and satellite droplets, and shows that actual placement of the main and satellite droplets in the left to right direction and in the right to left direction when fired from that nozzle bore.
Figure 20C:
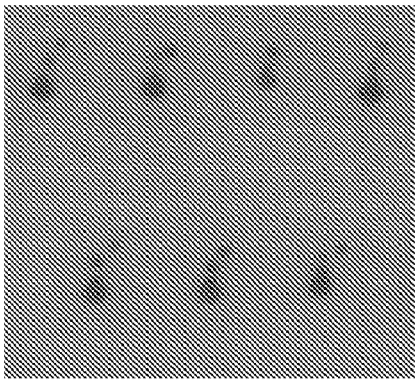
Figure 20A:
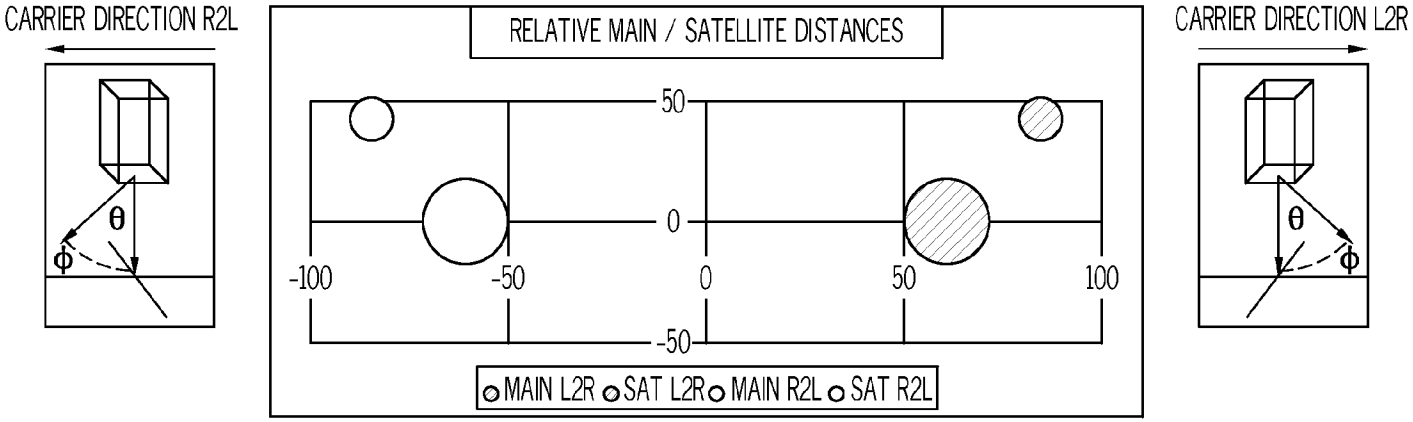
Figure 22A:
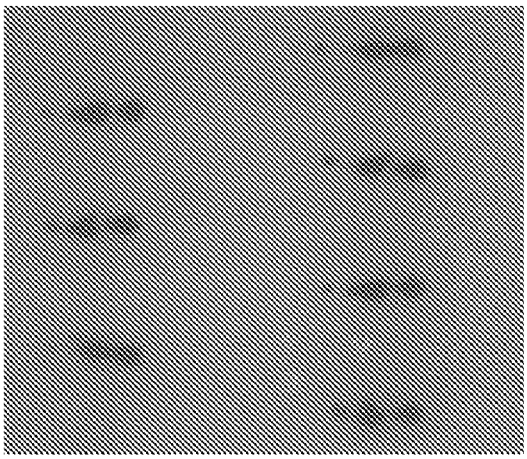
FIG. 22 shows that actual placement of the main and satellite droplets in the right to left direction and in the left to right direction when fired from the nozzle bores of FIG. 21.
Figure 22B:
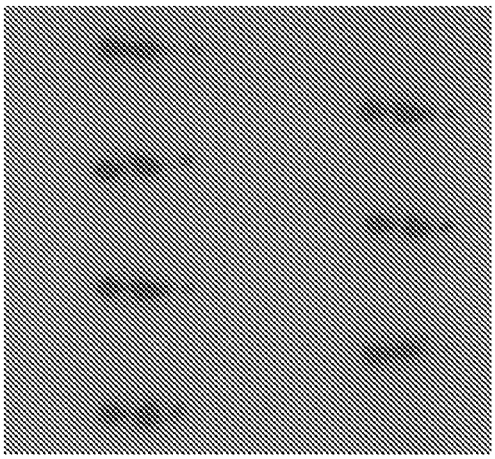
Figure 24A:
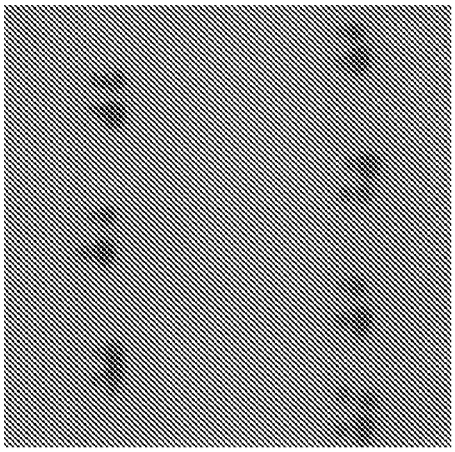
FIG. 24 shows that actual placement of the main and satellite droplets in the right to left direction and in the left to right direction when fired from the nozzle bores of FIG. 23.
Figure 24B:
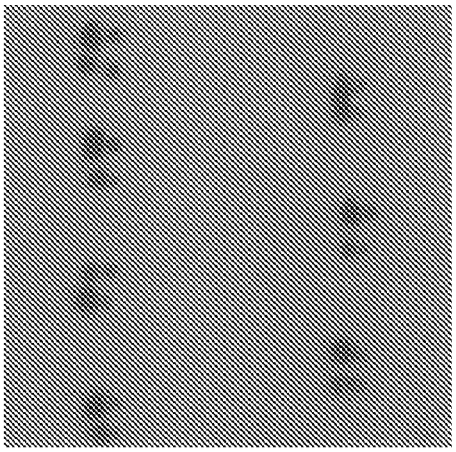

Once the printhead gap and drop velocities are known along with the associated tolerances for each, one can calculate the angular tolerance needed to maintain satellite droplet deflection up or down to fill in white space between main dots (see FIGS. 19 and 20).

Here it is the intent to purposefully change the satellite droplet location in the y-direction (printhead swath width) and to be able to increase the space between main drop and still have full coverage. Full coverage is achieved by filling in the white space between main drops using satellites deflected above or below the main drop on the printed page. Creating consistent doublets of equal or near equal mass instead of main drop and satellites with differing mass In the sixth embodiment of the present invention the nozzle openings are formed with two nozzles per heater and the bore angle is controlled to cause two droplets of approximately equal size and mass (see FIGS. 21–24), instead of a main drop and a smaller satellite.

By controlling the nozzle shape and the direction of the satellite drops relative to the main dot one can create doublets of equal or near equal mass. This allows very uniform controlled printing in both directions. This also allows one to control the effective aspect ratio of the drop, and can be used to increase resolution in one direction. This can be done in either the horizontal (x-direction—FIGS. 21 and 22) or the vertical (y-direction—FIGS. 23 and 24). It is done by constructing two nozzles per heater and by controlling bore angle of those nozzles.

A nozzle hole bore angled to the left causes main drop movement to the left. A bore angle to the right causes main drop movement to the right. Likewise a bore angled up causes the satellite droplets to land above the main drop, just as a bore angled down causes the satellite droplets to land below the main drop. Satellite droplet location with respect to the main drop depends on a number of factors that will be detailed below. Desired tolerance on bore angle for satellite droplet deflection depends on the drop velocity, carrier velocity, and paper gap. Gravity and air turbulence are ignored and have been found to be negligible in practice.

Once the printhead gap and drop velocities are known along with the associated tolerances for each, one can calculate the angular tolerance needed to maintain satellite droplet deflection desired.

Here it is the intent to purposefully change the satellite droplet location in the x-direction or the y-direction to change the aspect ratio of the drops deposited on the print.

By doing this one can accommodate different resolution in x and y directions and still maintain high quality bi-directional printing.

Figure 25:
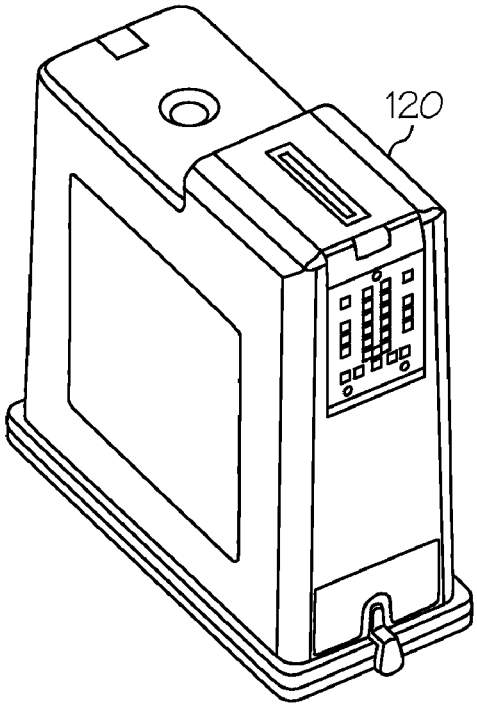
FIG. 25 is a perspective view of an exemplary embodiment of an inkjet print head of the present invention.
Figure 26:
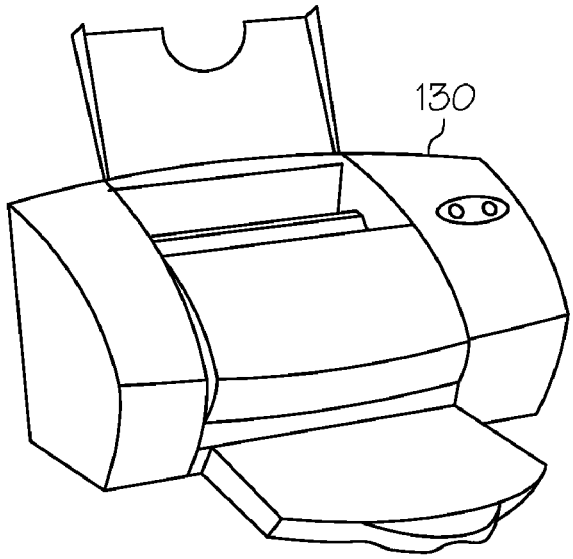
FIG. 26 is a perspective view of an exemplary embodiment of the inkjet printer of the present invention.

Inkjet print head 120 (FIG. 25) can include any of the nozzle bore layouts of any of the embodiments disclosed herein. Inkjet printer 130 (FIG. 26) includes inkjet print head 120. Other than the novel nozzle bore layouts of the present invention, inkjet printer 130 could be the same as, for example, Lexmark® Model Z51, Lexmark® Model Z31, and Lexmark® Model Z11, Lexmark® Photo Jetprinter 5770, or Kodak® PPM200 ink jet printers.

Processes for Manufacture of Directed Nozzles

There are several ways to manufacture directed nozzles. An exemplary current process is to use an eximer laser (such as Lambda Physik brand eximer laser, model NovaLine or LPX, commercially available from Lambda Physik) to ablate nozzle hole features in polyimide film. A chrome mask can for example be used to provide the ablation patterns. The nozzle plates can then be die-cut from the film. Other nozzle-plate films could be, for example, polyethersulfone, liquid crystal polymer, polyimide ether, or polyether ether ketone, though polyimide is preferred. These other films can for example be about 10–75 microns thick. A mask other than chrome could be used, such as any material that would block the laser beam and not be degraded by the beam energy). The mask can for example be about 0.5–3.0 millimeters thick.

In order to produce balanced satellites (as in the first embodiment), laser beam perpendicularity at the object surface should be within about 0.5 degrees, more preferably within about 0.3 degrees, and most preferably within about 0.1 degrees from normal to the nozzle plate film. Hole concentricity can be verified by ablation of a material (such as polyethersulfone, liquid crystal polymer, polyimide ether, polyether ether ketone, or polyimide ) that is thicker (typically about 25–125 microns thick) than the normal nozzle plate material.

If the nozzles are to be directed all in one direction (as in the third and fifth embodiments), the laser beam can for example be angled (typically about 1–10 degrees from normal, preferably about 1–5 degrees from normal, and more preferably about 1–3 degrees from normal) by adjusting the laser optics and verifying beam angle by ablation of a material (such as polyethersulfone, liquid crystal polymer, polyimide ether, polyether ether ketone, or polyimide) that is thicker (typically about 25–125 microns thick) than the normal nozzle plate material.

If nozzles are to be directed in multiple directions (as in the second, fourth, and sixth embodiments), the laser beam can for example be adjusted to be normal to the ablated material. An ablation mask can for example be used that has greyscale (uniform small geometric or non geometric shapes that reduce beam transmission, but do not image) to reduce the beam power in a portion of the ablated hole features. Examples of ablation mask material include chrome on glass, where chrome is the patterned material. These masks can for example be drawn with a CAD package, and chrome can for example be the patterned material.

By using a greyscale mask the wall angle of a portion of the circumference of the ablated holes can be varied to produce the desired non-concentric holes for directing the droplets of ink from the printhead. This is done in the following manner: The greyscale mask is designed to reduce the laser beam energy on one side of each nozzle hole gradually outward radially to the edge of the hole. This produces a nozzle hole with more wall taper on one side than the other. The hole concentricity is shifted in the desired direction. The tangent of the angle produced is the difference between the centroid of the laser entrance hole and the centroid of the laser exit hole divided by the thickness of the ablated material.

U.S. Pat. Nos. 5378137; 5417897; 5467115; 5948289; 6361145; and 6454393 disclose various methods for making nozzles which could be used to make the nozzles of the present invention.

Parts List:

The following is a list of parts and materials suitable for use in the present invention:

120 inkjet print head of the present invention

130 inkjet printer including print head 120

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. Apparatus including a printhead for an inkjet printer, the printhead comprising: an ink reservoir; nozzles for ejecting ink from the ink reservoir onto print media, the nozzles being formed in the ink jet printer printhead in a predetermined fashion with bores purposefully shaped and/or directed to determine the formation and placement of satellite droplets when ink is ejected from the ink reservoir when the printhead is part of an inkjet printer;

wherein: (a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) a second plurality of the nozzles have the axes of their bores aligned in a second direction, (f) a plurality of heaters are used to eject ink through the nozzles, and each heater ejects ink through a first nozzle from the first plurality of nozzles and a second nozzle from the second plurality of nozzles, (g) the nozzles are aligned and directed such that when ink is ejected through the nozzles, satellite droplets ejected through the first plurality of the nozzles are offset from the main drops ejected through the first plurality of the nozzles in a different direction from which satellite droplets ejected through the second plurality of the nozzles are offset from the main drops ejected through the second plurality of the nozzles, such that: in a first direction of printing, the main drop from the first nozzle associated with a heater at least partially overlaps the satellite droplet from that nozzle and at least partially overlaps the satellite droplet from the second nozzle associated with that heater, and in a second direction of printing, the main drop from the second nozzle associated with a heater at least partially overlaps the satellite droplet from that nozzle and at least partially overlaps the satellite droplet from the first nozzle associated with that heater.

2. The apparatus of claim 1, further comprising an inkjet printhead comprising the inkjet printhead chip.

3. The apparatus of claim 2, further comprising an ink jet printer comprising the inkjet printhead.

4. The apparatus of claim 2, wherein the printhead has large and small nozzles.

5. The apparatus of claim 1, wherein the nozzle bores are formed in polyimide film.

6. The apparatus of claim 1, wherein the nozzle bores are cut with an eximer laser.

7. A method of controlling the formation and placement of satellite droplets ejected from an ink jet printer printhead comprising the steps of: providing an ink jet printer printhead having an ink reservoir; forming nozzles in the ink jet printer printhead; installing the printhead in an ink jet printer; ejecting ink from the reservoir through the nozzles in the form of main drops and satellite droplets in a manner to achieve uniform density control by controlling the formation and placement of satellite droplets when ink is ejected from the reservoir of the ink jet printer printhead when the printhead is part of an inkjet printer;

wherein: (a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) a second plurality of the nozzles have the axes of their bores aligned in a second direction, (f) a plurality of heaters are used to eject ink through the nozzles, and each heater ejects ink through a first nozzle from the first plurality of nozzles and a second nozzle from the second plurality of nozzles, (g) the nozzles are aligned and directed such that when ink is ejected through the nozzles, satellite droplets ejected through the first plurality of the nozzles are offset from the main drops ejected through the first plurality of the nozzles in a different direction from which satellite droplets ejected through the second plurality of the nozzles are offset from the main drops ejected through the second plurality of the nozzles, such that: in a first direction of printing, the main drop from the first nozzle associated with a heater at least partially overlaps the satellite droplet from that nozzle and at least partially overlaps the satellite droplet from the second nozzle associated with that heater, and in a second direction of printing, the main drop from the second nozzle associated with a heater at least partially overlaps the satellite droplet from that nozzle and at least partially overlaps the satellite droplet from the first nozzle associated with that heater.

8. Apparatus including a printhead for an inkjet printer, the printhead comprising: an ink reservoir; nozzles for ejecting ink from the ink reservoir onto print media, the nozzles being formed in the ink jet printer printhead in a predetermined fashion with bores purposefully shaped and/or directed to determine the formation and placement of satellite droplets when ink is ejected from the ink reservoir when the printhead is part of an inkjet printer;

wherein ink is ejected through each nozzle at a fire point and wherein: (a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) when ink is ejected through the nozzles, each of the satellite droplets ejected through the first plurality of the nozzles is offset from the main drop ejected through the first plurality of the nozzles in substantially the same direction and at substantially the same distance; (f) a second plurality of the nozzles have the axes of their bores aligned in a second direction, and (g) when ink is ejected through the nozzles, the main drops ejected through the first plurality of the nozzles are offset in a different direction from the fire point from which main drops ejected through the second plurality of the nozzles are offset from the fire point.

9. A method of controlling the formation and placement of satellite droplets ejected from an ink jet printer printhead comprising the steps of: providing an ink jet printer printhead having an ink reservoir; forming nozzles in the ink jet printer printhead; installing the printhead in an ink jet printer; ejecting ink from the reservoir through the nozzles in the form of main drops and satellite droplets in a manner to achieve uniform density control by controlling the formation and placement of satellite droplets when ink is ejected from the reservoir of the ink jet printer printhead when the printhead is part of an inkjet printer;

wherein ink is ejected through each nozzle at a fire point and wherein: (a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) when ink is ejected through the nozzles, each of the satellite droplets ejected through the first plurality of the nozzles is offset from the main drop ejected through the first plurality of the nozzles in substantially the same direction and at substantially the same distance, (f) a second plurality of the nozzles have the axes of their bores aligned in a second direction, (g) when ink is ejected through the nozzles, the main drops ejected through the first plurality of the nozzles are offset in a different direction from the fire point from which main drops ejected through the second plurality of the nozzles are offset from the fire point.

10. The apparatus as in any of claim 1 or 8, wherein the nozzle bores are oriented such that they eject ink opposite the direction of travel of the printhead when the print head is moving and printing.

11. The method as in any of claim 7 or 9, wherein the nozzle bores are oriented such that they eject ink opposite the direction of travel of the printhead when the printhead is moving and printing.

12. The method as in any of claim 7 or 9, further comprising the step of providing an inkjet printhead comprising the inkjet printhead chip.

13. The method of claim 12, Farther comprising the step of providing an ink jet printer comprising the inkjet printhead.

14. The method as in any of claim 7 or 9, wherein the printhead has large and small nozzles.

15. The method as in any of claim 7 or 9, wherein the nozzle bores are formed in polyimide film.

16. The method as in any of claim 7 or 9, wherein the nozzle bores are cut with an eximer laser.

17. Apparatus including a printhead for an inkjet printer, the printhcad comprising:

an ink reservoir; nozzles for ejecting ink from the ink reservoir onto print media, the nozzles being formed in the ink jet printer printhead in a predetermined fashion with bores purposefully shaped and/or directed to determine the fonnation and placement of satellite droplets when ink is ejected from the ink reservoir when the printhead is part of an inkjet printer;

wherein: (a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) when ink is ejected through the nozzles, each of the satellite droplets ejected through the first plurality of the nozzles is offset from the main drop ejected through the first plurality of the nozzles in substantially the same direction and at substantially the same distance; and wherein the inkjet printhead travels laterally while printing, and, when placed on the print media, the satellite droplets are offset on a verical axis from the main drops on the print media.

18. The apparatus of claim 17, wherein the satellite droplets are directed onto the media vertically enough to be separated from the main drop on the media.

19. The apparatus of claim 17, wherein printing laterally in either direction produces main drops and satellite droplets with nearly equal combined areas on the media.

20. A method of controlling the formation and placement of satellite droplets ejected from an ink jet printer printhead comprising the steps of: providing an ink jet printer printhead having an ink reservoir; forming nozzles in the ink jet printer printhead; installing the printhead in an ink jet printer; ejecting ink from the reservoir through the nozzles in the form of main drops and satellite droplets in a manner to achieve uniform density control by controlling the formation and placement of satellite droplets when ink is ejected from the reservoir of the ink jet printer printhead when the printhead is part of an inlcjet printer;

wherein: (a) each of the nozzles produces a main drop and a satellite droplet when ink is ejected through the nozzles, (b) each nozzle includes a bore, (c) each bore has an axis, (d) a first plurality of the nozzles have the axes of their bores aligned in a first direction, (e) when ink is ejected through the nozzles, each of the satellite droplets ejected through the first plurality of the nozzles is offset from the main drop ejected through the first plurality of the nozzles in substantially the same direction and at substantially the same distance; and wherein the inkjet print head travels laterally while printing, and, when placed on the print media, the satellite droplets are offset on a vertical axis from the main drops on the print media.

21. The method of claim 20, wherein the satellite droplets are directed onto the media vertically enough to be separated from the main drop on the media.

22. The method of claim 20, wherein printing laterally in either direction produces main drops and satellite droplets with nearly equal combined areas on the media.

* * * * *